United States Patent [19]

Kikuchi et al.

[11] Patent Number: 4,924,999

[45] Date of Patent: May 15, 1990

[54] PACKAGE TRANSFER SYSTEM

[75] Inventors: Shuichi Kikuchi, Shiga; Yoshio Yamamoto; Yoshihiko Kawasaki, both of Kyoto, Japan

[73] Assignee: Murata Kikai Kabushiki Kaisha, Kyoto, Japan

[21] Appl. No.: 217,873

[22] Filed: Jul. 12, 1988

[30] Foreign Application Priority Data

Jul. 21, 1987 [JP] Japan ..... 62-110602
Jul. 22, 1987 [JP] Japan ..... 62-180974

[51] Int. Cl.[5] ..... B65G 25/00

[52] U.S. Cl. ..... 198/409; 198/468.6; 198/487.1; 198/803.12; 242/35.5 A

[58] Field of Search ..... 198/409, 803.12, 468.6, 198/487.1, 470.1, 803.9; 242/35.5 A

[56] References Cited

U.S. PATENT DOCUMENTS 3,788,054 1/1974 Haussmann et al. ..... 198/487.1 X
4,088,226 5/1978 Vlček ..... 198/487.1 X
4,650,062 3/1987 Uchida ..... 198/468.6 X
4,730,733 3/1988 Kawamura et al. ..... 198/487.1 X
4,763,773 8/1988 Kawarabashi et al. ..... 242/35.5 A
4,783,021 11/1988 Nagasawa ..... 198/487.1 X
4,810,155 3/1989 D'Agnola ..... 198/487.1 X

*Primary Examiner*—Robert J. Spar
*Assistant Examiner*—Cheryl L. Gastineau
*Attorney, Agent, or Firm*—Spensley, Horn, Jubas & Lubitz

[57] ABSTRACT

A package transfer system in which packages discharged from a winder in a prostrate posture with the respective longitudinal axis disposed substantially in the horizontal direction are transferred to a next stage and placed with the respective axes in a vertically aligned state. It includes a package aligning device located contiguously to the discharge end of the winder and adapted to align the discharged packages in a stand-by position with the respective axes in the vertical direction and a package transfer device adapted to hang up the packages arbitrarily aligned by the package aligning device for transfer to a next stage in the aligned state.

14 Claims, 5 Drawing Sheets

PACKAGE TRANSFER SYSTEM

FIELD OF THE INVENTION

This invention relates to a package transfer system, and more particularly to a package transfer system for transferring packages discharged from winders to a next stage.

RELATED ART STATEMENT

As a transfer system for transferring packages discharged from juxtaposed winders to a next stage, there has been known a system employing a conveyor means which is movable along an overhead track such as chain conveyer or rail.

As illustrated in FIG. 11, in a conventional system of this sort, a chain conveyer 43 with hook hangers 44 for packages P is extended between the discharge end 41 of a winder W and, for example, a station 42 where the packages are packed in stacked form for shipment. Package loading and unloading lift mechanism 45 and 46 at the opposite ends of the chain conveyer 43 are used for putting the packages on and off the hangers 44.

However, in a case where a large number of winders are juxtaposed to enhance the package production, the transfer system which hooks the packages one after another on and off the hangers 44 has a limit in the handling speed, resulting in stagnation of the packages to be transferred to the next stage of the operation.

The packages P which are discharged from the winders are in a prostrate posture with the respective rotational axes Po substantially in the horizontal direction, and transferred in that posture along a transfer path which extends on one side of the winders W. Heretofore, it has been the usual practice to stop the packages P in that state by inserting an end portion of a hanger 44 into the hollow tube of each package. Therefore, it has been necessitated to resort to manual labor in order to align the packages in upright posture which is stable and convenient for the handling in a subsequent stage, barring improvements of the package transfer efficiency.

OBJECT AND SUMMARY OF THE INVENTION

It is an object of the present invention to provide a package transfer system which can arrange and transfer packages speedily ensuring smooth operation in the next stage.

In accordance with the present invention, there is provided a package transfer system in which packages discharged from a winder in a prostrate posture with the respective longitudinal axis disposed substantially in the horizontal direction are transferred to a next stage and placed with the respective axes in a vertically aligned state, a package transfer system comprising: a package aligning means located contiguously to the discharge end of the winder and adapted to align the discharged packages in a stand-by position with the respective axes in the vertical direction; and a package transfer means adapted to hang up the packages arbitrarily aligned by said package aligning means for transfer to a next stage in the aligned state.

The package transfer system of the present invention includes a package transfer mechanism comprising: a package holding means to be inserted into a hollow tube of each package and capable of increasing and reducing the diameter thereof for holding and releasing the packages by coupling and uncoupling operations; and a lift and transfer means adapted to transfer the package holding means from the pick-up position to a position of the next stage and lift the package holding means up and down at said positions at the time of the insertion and the coupling and uncoupling operations.

DETAILED DESCRIPTION OF PREFERRED EMBODIMENTS

Hereafter, preferred embodiments of the invention are described with reference to the accompanying drawings.

Figure 1:
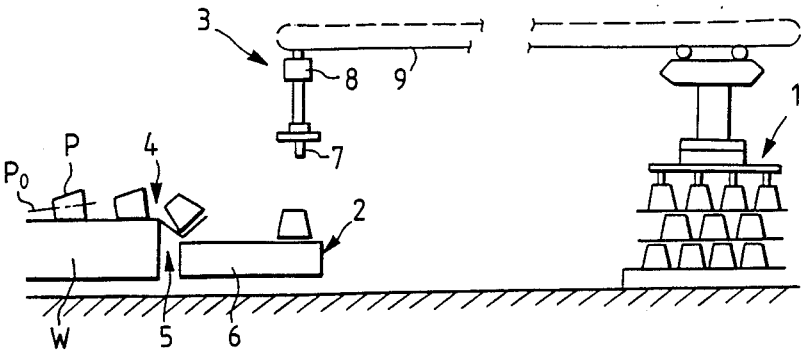
FIG. 1 is a side view of an embodiment of the package transfer system according to the present invention.
Figure 2:
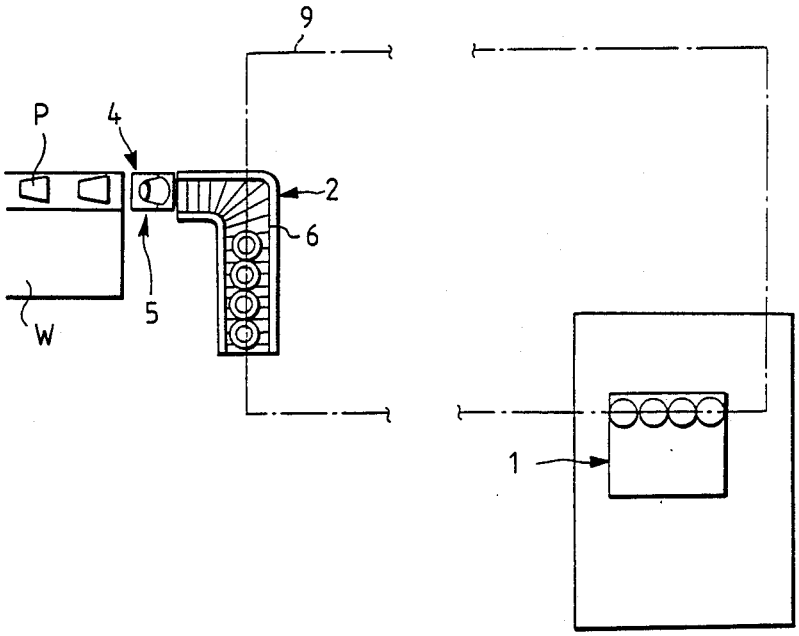
FIG. 2 is a plan view of the transfer system.

Referring to FIGS. 1 and 2, there is illustrated an embodiment of the package transfer system according to the present invention, which is located to connect the package discharge end of a winder W and a next stage of operation 1 where the packages P are stacked and packed.

This package transfer system is constituted by a package aligning means 2 and a package transfer means 3. The package aligning means 2 is located contiguously to the discharge ends of winders W, and provided with a posture changing member 5 for changing the posture of the packages P which are discharged in prostrate state with the respective axes Po substantially in the horizontal direction, turning the axes Po of the packages P into the vertical direction, and a conveyer 6 for receiving the packages P from the posture changing member 5 and aligning a desired number of packages P thereon.

The package transfer means 3 is provided with a package holder device 7 which is engageable with a package P for lifting same; and a lift and transfer member 8 for lifting and transferring the package holder device 7. This lift and transfer member 8 is moved along a transfer path 9 which is in the form of a closed loop when viewed from above and provided with a conveyer 6 which extends in the transfer direction. Namely, the aligning direction coincides with the transfer direction. A member of the package holder device 7 is spread into a greater diameter when inserted from above into a take-up tube 0 of the package P which is aligned in a stand-by position on the conveyer 6, for engagement with the package P. At the time of disengagement, the member of the package holder device is displaced into a reduced diameter to release the package.

Now, the constructions of the respective means are described in greater detail.

Figure 3:
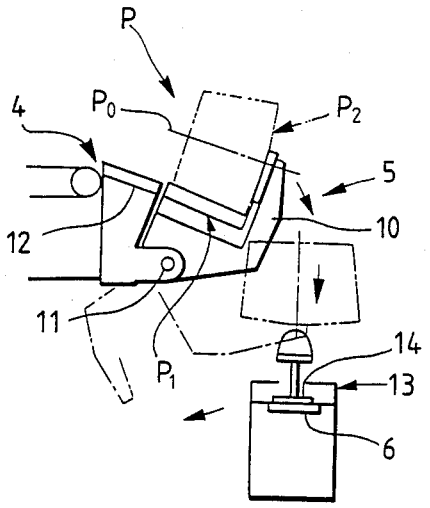
FIG. 3 is a side view of a posture turning portion.

As shown particularly in FIG. 3, the posture changing member 5 includes a receptacle member 10 of substantially L-shape which fits the side face P1 and bottom face P2 of the package P, and a rotational shaft 11 which rotatably supports the receptacle member 10. Interposed between the receptable member 10 and the discharge end of a winder W is a guide plate 12 by which the package P is placed on the receptacle member 10 upon reaching the discharge end. Though not shown in the drawing, a sensor which is provided in the vicinity of the receptacle member is connected to a drive means (not shown) which suitably drives the receptacle member 10. As soon as a package P on the receptacle member 10 is detected, it is turned by a predetermined angle, changing the posture of the package P to turn its bottom face P2 in the direction to which the package is transferred. The upstream end 13 of the transfer conveyer 6 is located within the locus of this turn to hand over the package on the transfer conveyer 6 in upright posture with its axis Po in the vertical direction.

Figure 4:
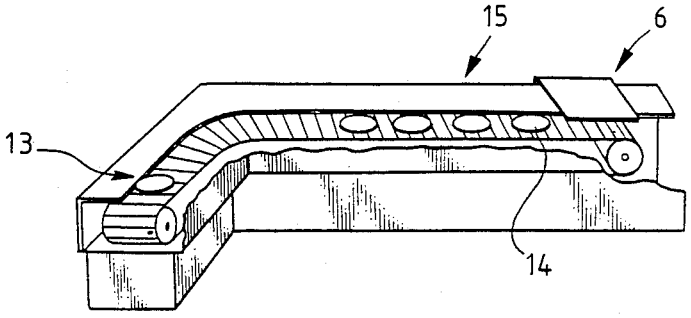
FIG. 4 is a partly cutaway perspective view of a conveyer.

As illustrated in FIG. 4, the conveyer 6 is formed substantially in L-shape, and trays 14 which keep the packages P in the upright posture are mounted thereon at predetermined intervals. The conveyer 6 is driven intermittently in a pitch corresponding to the intervals between the trays 14. A stand-by zone 15 for pooling a desired number of packages P is provided at the downstream end of the transfer line of the conveyer 6, and sensors (not shown) are located in the vicinity of the stand-by zone to detect the presence or absence of the packages.

Figure 5:
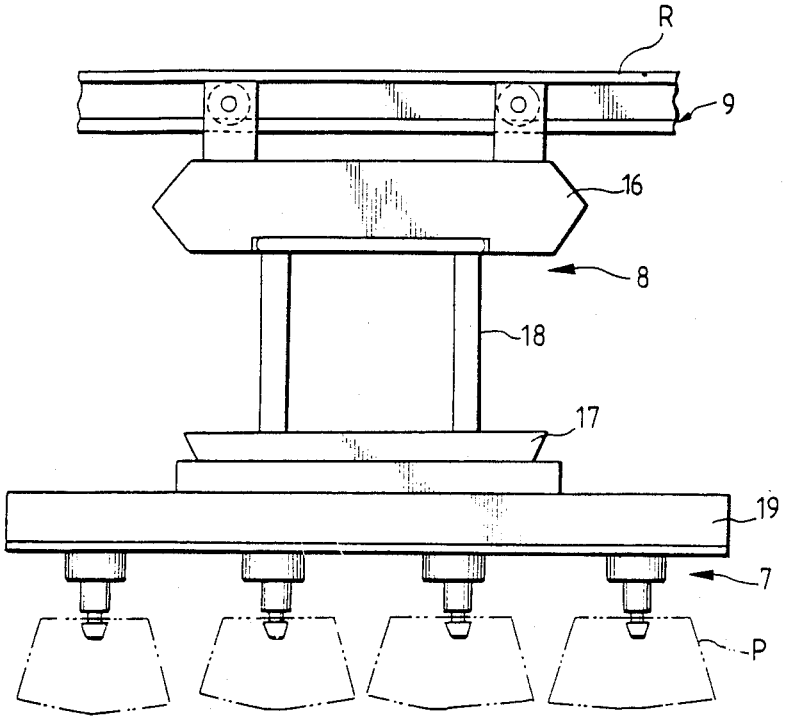
FIG. 5 is a side view of a package transfer means.

As shown in FIG. 5, the lift and transfer member 8 includes an overhead self-travelling carriage 16 which is movable along an overhead rail R constituting the transfer path, a lift plate 17 vertically movably suspended from the overhead carriage 16. The overhead carriage 16 is provided with a drive source (not shown) for moving same, and the lift plate 17 is suspended therefrom through steel belts 18 which are windable upwards or downwards.

In this particular embodiment, the package holding device 7 is provided in four positions, namely, in four uniformly spaced positions on a bracket 19 which is fixedly secured to the lift plate 17.

Now, the description is directed to the package holding device 7 of this embodiment.

Figure 6:
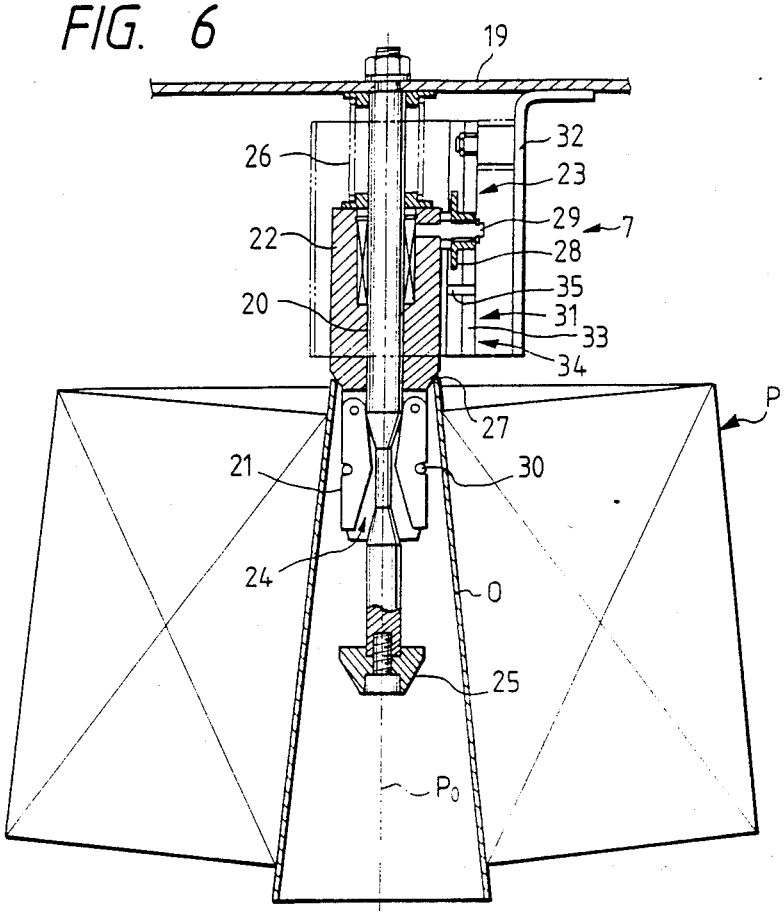
FIG. 6 is a vertical section of major components of the package transfer means.
Figure 11:
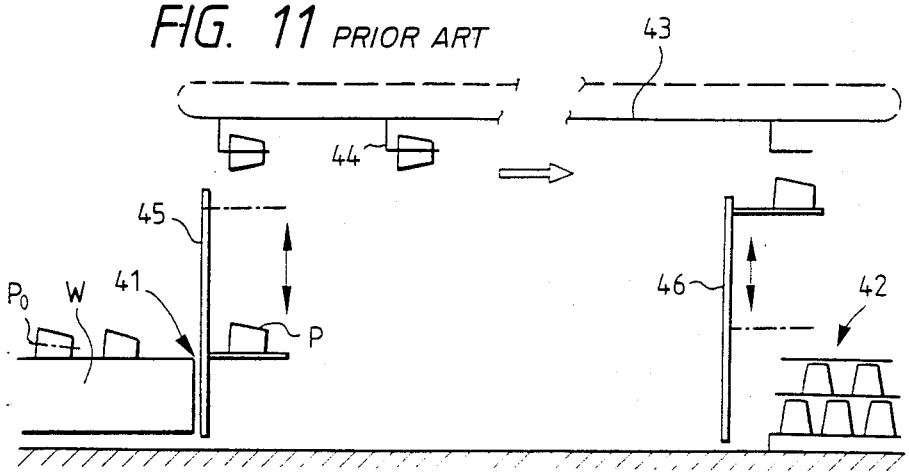
FIG. 11 PRIOR ART
FIG. 11 is a side view of a conventional package transfer system.

As illustrated in FIG. 6, each package holding device 7 includes a rod 20 hanging down from the bracket 19, a sliding sleeve 22 slidably fitted around the rod 20 and provided with coupling member 21, and a coupling adjustor member 23 for operating the coupling member 21 by sliding the sliding sleeve 22 and rod 20.

The rod 20 is provided with a constricted portion 24 at a predetermined position, and a conical member 25 in a lower end portion for guiding the insertion into the take-up tube O of the package P.

The sliding sleeve 22 is suspendedly supported at its upper end on the bracket 19 through a spring 26, and formed with an abutting portion 27 which is radially extended outward at a position above the coupling member 21 at its lower end for abutting engagement with the upper end of the take-up tube O. Namely, the lower portion including the coupling levers 21 is inserted into the package P. In the upper portion which is not inserted into the package P, a rotational shaft 29 is projected for rotatably supporting a rotary lever 28 which serves as the coupling adjustor member 23.

In this embodiment, the coupling member 21 consists of four coupling levers which are pivotally supported for turns in the upward and radial directions, and fitted in an annular spring 30 which is biased in the closing direction to hold them substantially in a reduced diameter. When the sliding sleeve 22 is slided upward, they are turned radially outward by the rod 20 which is positioned below the constricted portion 24 to spread them substantially into a greater diameter, pressing the take-up tube O from inside for coupling therewith.

The coupling adjustor member 23 is constituted by the rotary lever 28, and a rotary lever guide member 31 which stops the rotary lever 28 at a predetermined position. The rotary lever guide member 31 consists of a pair of plates 33 and 34 which are fixedly secured to the bracket 19 of the lift plate 17 through a bracket 32 in such a manner that they extend along the rod 20 and sliding sleeve 22. When the rotary lever 28 is in a vertical posture to be parallel to the axis of the rod 20, these plates 33 and 34 are parallelly spaced apart at a predetermined distance from each other to permit vertical sliding movement of the sleeve 22. Further, these plates 33 and 34 are provided with a stopper pin 35 which blocks relative downward movement when the rotary lever 28 is in a horizontal posture. Namely, when the sliding sleeve 22 tends to slide downward under the influence of the spring 26, the stopper pin 35 prevents engagement of the coupling levers 21 with the rod 20.

Figure 7:
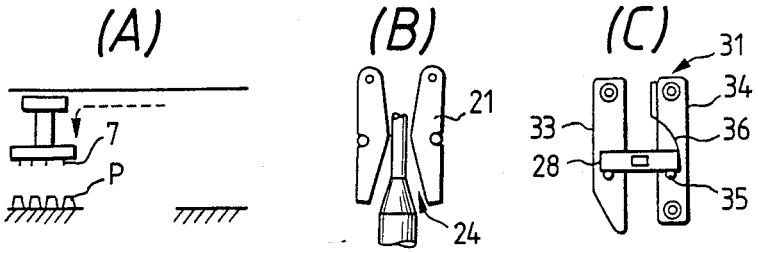
FIGS. 7 to 10 are schematic illustration explanatory of operations, showing the whole arrangement (A), coupling levers (B) and coupling adjustor (C), side by side, respectively.

As shown in FIG. 7-(C), one plate 33 of the rotary lever guide member 31 is pivotally supported at its upper end, while the other plate 34 is fixed at its upper and lower ends and formed with a notch 36 at a position which is spaced from the stopper pin 35 by a predetermined distance. This notch 36 is abutted against one end of the rotary lever 28 and turns the latter clockwise when the rotary lever 28 in a horizontal posture is relatively moved from beneath beyond the position of the stopper pin 35. Namely, it is turned into a horizontal posture and abutted against the stopper pin 35. When the rotary lever 28 is apparently moved upwardly afterwards, the abutted end thereof is held on the position of the stopper pin 35 while the other end thereof is moved to turn the rotary lever 28 into the vertical posture.

Now, the performance of this embodiment is described in the order of the operation.

The packages P which are discharged from the juxtaposed winders W are in prostrate state with the respective axes Po substantially in the horizontal direction. The receptacle member 10 receives the package P and turns its posture, placing the package P on the conveyer 6 in an upright posture with the axis Po in the vertical direction. The conveyer 6 transfers the packages to the stand-by zone 15 one after another in aligned state in the direction of the transfer path 9 of the package transfer means 3.

As soon as four packages P are aligned in the stand-by zone 15, the package holding device 7 is lowered by the lift and transfer member 8 to insert it is into the packages P. The package holding device 7 is then coupled with the take-up tube O and lifted to hang up the package P. The package holding device 7 which holds the package P in suspended state is moved along the transfer path 9 by the lift and transfer member 8. Upon reaching the packing station 1, the package holding device 7 are lowered and released to place the package P on a stacking pallet. The lift and transfer member 8 lifts up the holding device 7 again to transfer it to the position of the conveyer 6.

Thereafter, the same operation is repeated.

Now, the description is directed to the operation of the package holding device 7.

As illustrated in FIG. 7-(A) to FIG. 7-(C), when the package holding device 7 is lowered toward the packages P from above, the rotary lever 28 is held in locked state (C) by the stopper pin 35, and the coupling levers 21 are in positions on the constricted portion 24, namely, in a compact state (B) of a substantially reduced diameter.

Figure 8:
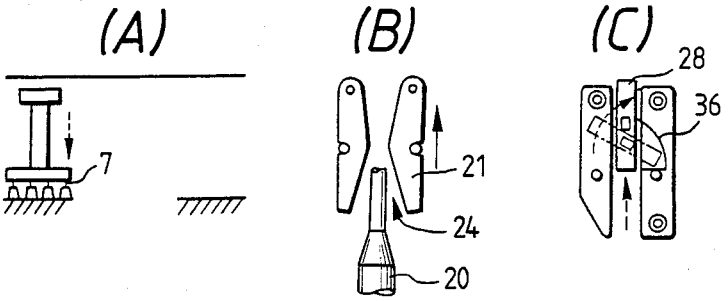

As the package holding device 7 is further lowered to insert the rod 20 into the take-up tube O as shown in FIG. 8-(A) to FIG. 8-(C), the abutting portion 27 is abutted against the upper end of the take-up tube O to block the downward movement of the sliding sleeve 22 which slides in the axial direction of the rod 20. That is to say, the sliding sleeve 22 is moved upwardly relative to the rod 20. At this time, one end of the rotary lever 28 is abutted against the notch 23 and thereby turned clockwise in the drawing (C) to take the vertical posture. Then, the coupling levers 21 are located further upward of the constricted portion 24.

Figure 9:
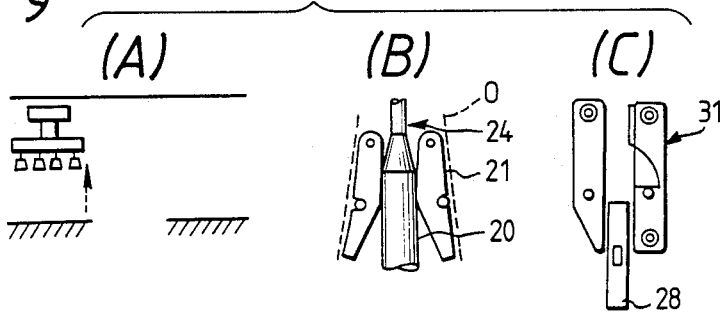

As seen in FIG. 9-(A) to FIG. 9-(C), the sliding sleeve 22 is relatively moved downward by raising the package holding device 7 after lowering the same to a predetermined position. At this time, the rotary lever 28 is held in an apparently vertically movable state (C) by the guide member 31. As a result, the coupling levers 21 are pushed and spread into a larger diameter by the rod 20 which is positioned beneath the constricted portion 24, fittingly engaging with the take-up tube O tightly from inside to hang up the same. Thus, the package P is integraly coupled with the package holding device 7, and transferred to a desired delivery point.

Figure 10:
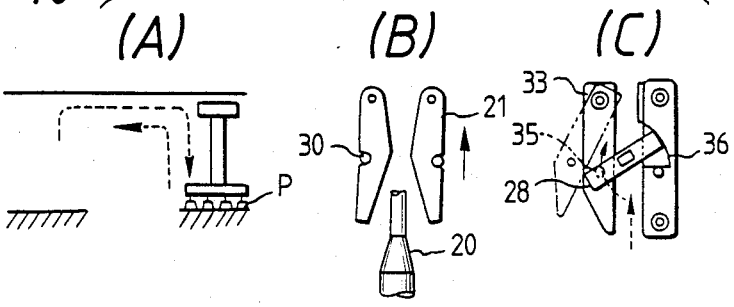

As illustrated in FIG. 10-(A) to FIG. 10-(C), upon reaching a point above the delivery position, the package holding device 7 is lowered to set down the packages P. Then, each holding device 7 is further lowered into the take-up tube O of the package P, whereupon the sliding sleeve 22 is slided upward again. At this time, the rotary lever 28 which has its one end abutted against the notch 36 is turned clockwise in the drawing, making a relative upward movement, while the other end pushes up the stopper pin 35 of one plate 33 from beneath and turns same to release its blockage (C). The coupling levers 21 are moved away from the lower portion of the rod 20 and closed by the annular spring 30, shrinking into a reduced diameter to substantially disengage from the take-up tube O. When raised, the rotary lever 28 is stopped as shown in FIG. 7-(C), fixing the sliding sleeve 22 in the middle of the sliding movement.

In this manner, each time a desired number of packages are transferred in upright posture which is suitable for stacking as they are, increasing the operational speed to a marked degree. Besides, the package holding device of this embodiment can be coupled with and uncoupled from the packages simply by lifting them up and down, unnecessitating the provision of a drive mechanism which otherwise has to be mounted on the carriage or lift plate. Therefore, it becomes possible to reduce the weight and simplify the construction of the transfer means. Further, the transfer system of the invention has high versatility, permitting to install the conventional traveller carriage (or lift plate) easily.

Although the packing work is exemplified as a next stage in the foregoing embodiment, the present invention can be effectively used also for making a supply to a machine or the like, and can adapt flexibly to various conditions of the machine installation by suitably providing the transfer path.

As clear from the foregoing description, the present invention has excellent effects as follows.

Since the packages which are discharged from a winder are transferred in aligned state and in upright posture with the respective axes in the vertical direction, the transfer operation is performed speedily, ensuring smooth operation in the next stage as well as improvements in the package production efficiency.

What is claimed is:

1. A package transfer system in which a plurality of packages, each having a longitudinal axis, are discharged from a discharge end of a winder with each respective longitudinal axis disposed substantially in a horizontal direction, for transferring the packages to a next stage with each respective axis aligned in a substantially vertical direction, comprising:

package aligning means located adjacent to the discharge end of the winder and adapted to align the discharged packages in a standby position with the respective axes in the vertical direction; and a package transfer means for lifting and transferring the vertically aligned packages, wherein the package transfer means further comprises:

a guide rail defining a path between the winder and the next stage, the rail elevated above the winder and the next stage, a movable carriage which is movable along the guide rail, a lift plate vertically movably suspended from the carriage, a bracket secured to the lift plate, and a plurality of package holding devices provided on the bracket.

2. A package transfer system as claimed in claim 1, wherein the package aligning means further comprises a conveyor for aligning the packages in the standby position.

3. A package transfer system as claimed in claim 1, wherein the package aligning means further comprises a turning means for turning the packages so that each respective longitudinal axis is aligned in the vertical direction.

4. A package transfer system as claimed in claim 3, wherein the turning means further comprises a receptacle member of substantially L-shape for supporting the package, a shaft which rotatably supports the receptacle member, and a driving means for rotating the receptacle member.

5. A package transfer system as claimed in claim 4, further comprising, a guide plate located between the receptacle member and the discharge end of the winder, one end the conveyor being located adjacent the receptacle member so that the packages are aligned on the conveyor with each respective axis aligned in the vertical direction.

6. A package transfer system as claimed in claim 1, wherein each of the package holding devices further comprises:

a rod hanging down from the bracket, a sliding sleeve fitted around the rod, a coupling member having an adjustable diameter, and a coupling adjustor member for adjusting the coupling member by sliding the sliding sleeve and the rod, the coupling adjustor member being capable of increasing and reducing the diameter of the coupling member for holding and releasing the packages.

7. A package transfer system as claimed in claim 6, wherein the coupling member comprises, a pair of coupling levers which are pivotally attached to the sleeve, and an annular spring fitted on the coupling levers to bias the coupling levers substantially towards the rod.

8. A package transfer system as claimed in claim 7, wherein the rod is located between the coupling levers and has a large diameter portion so that the coupling levers increase the diameter of the coupling member when the levers contact the large diameter portion, and a small diameter portion so that the coupling levers decrease the diameter at the coupling member when the levers contact the small diameter portion.

9. A package transfer system comprising:

a package transfer system in which a plurality of packages, each having a longitudinal axis, are discharged from a discharge end of a winder with each respective longitudinal axis disposed substantially in a horizontal direction, the packages being transferred to a next stage and placed with each respective axis in a substantially vertical direction, comprising:

package aligning means located adjacent to the discharge end of the winder and adapted to align the discharged packages in a standby position with the respective axes in the vertical direction;

a package transfer means for lifting and transferring the vertically aligned packages, wherein said package transfer means further comprises, a guide rail defining a path between the winder and the next stage, the rail elevated above the winder and the next stage, a movable carriage which is movable along the guide rail, a lift plate vertically movably suspended from the carriage, a bracket secured to the lift plate, and a plurality of package holding devices provided in uniformly spaced positions on the bracket;

a rod hanging down from the bracket;

a sliding sleeve fitted around the rod;

a coupling member having an adjustable diameter;

a coupling adjustor member for operating the coupling member by sliding the sliding sleeve and the rod, the coupling adjustor member being capable of increasing and reducing the diameter of the coupling member for holding and releasing the packages; wherein the coupling member further comprises a pair of coupling levers which are pivotally attached to the sleeve for adjusting the diameter of the coupling member, and an annular spring fitted on the coupling levers to bias the coupling levers substantially towards the rod, wherein the rod is located between the coupling levers and has a large diameter portion so that the coupling levers increase the diameter of the coupling member when the levers contact the large diameter portion, and small diameter portion so that the coupling levers decrease the diameter of the coupling member when the levers contact the small diameter portion;

wherein the coupling adjustor member further comprises a rotary lever rotatably supported by a rotational shaft, and a rotary lever guide member which stops the rotary lever at a predetermined position, the rotary lever guide member comprising a first plate which is pivotally supported at its upper end and has a first stopper to block relative downward movement of the rotary lever, and a second plate which is fixed at its upper and lower ends and is parallel to and spaced apart from the first plate, and has a notch at a position spaced from a second stopper mounted thereon, so that the guide lever engages the first and second pins to adjust the diameter of the coupling member.

10. A package transferring apparatus for transferring packages from a horizontally aligned position at a first station to a vertically aligned position at a second station, comprising:

package receiving and aligning means for receiving the packages in the horizontally aligned position and aligning the received packages vertically, package transporting means for transporting the vertically aligned packages from the first station to the second station, the package transporting means further comprising, a guide track defining a path between the first and second stations, the track being elevated above the first and second stations, a truck movably supported on the guide track, the truck following the path, and a plurality of holding devices mounted on the movable truck for releasably holding the vertically aligned packages.

11. A package transferring apparatus as claimed in claim 10, wherein the packages each have a hollow tube and each holding device further comprises:

a substantially vertical rod, a sleeve partially encircling the rod and mounted for sliding motion along the rod, a coupling member insertable into the hollow tube, having an adjustable diameter and mounted to the sliding sleeve, and adjusting means for selectively adjusting the diameter of the coupling member to engage or disengage the hollow tube, thereby holding or releasing the package.

12. A package transferring apparatus as claimed in claim 11, wherein the coupling member further comprises:

a pair of levers, each lever having a first and pivotally attached to the sleeve, and a second end movable radially outward from the rod to adjust the diameter of the coupling member.

13. A package transferring apparatus as claimed in claim 12, further comprising:

a thickened portion disposed on the rod, the levers contacting the rod, so that when the sleeve is moved relative to the rod the levers contact the thickened portion and are urged radially outward by the rod so that the diameter of the coupling member is increased.

14. A package transferring apparatus as claimed in claim 13, wherein the adjusting means further comprises:

a bracket mounted on the truck, a first plate having an upper end and a lower end, the first plate pivotally mounted at its upper end to the bracket, a first stop pin disposed on the first plate between the upper and lower ends thereof, a second plate fixedly mounted on the bracket, parallel to and spaced apart from the first plate, a second stop pin disposed on the second plate opposite the first stop pin, and a notch disposed on the second plate above the second stop pin, a guide lever having first and second ends and a midpoint, the guide lever being disposed between the first and second plates, and rotatable about the midpoint, so that the guide lever engages the first and second pins to adjust the diameter of the coupling member.

* * * * *